US006037957A

United States Patent [19]

Grande et al.

[11] Patent Number: 6,037,957

[45] Date of Patent: Mar. 14, 2000

[54] INTEGRATED MICROCHANNEL PRINT HEAD FOR ELECTROGRAPHIC PRINTER

[75] Inventors: William J. Grande, Pittsford; William Mey, Rochester; Thomas M. Stephany, Churchville, all of N.Y.

[73] Assignee: Eastman Kodak Company, Rochester, N.Y.

[21] Appl. No.: 08/909,174

[22] Filed: Aug. 11, 1997

[51] Int. Cl.[7] ..... B41J 2/39; B41J 2/395

[52] U.S. Cl. ..... 347/147

[58] Field of Search ..... 346/132, 138, 346/139 C, 139 D; 347/142, 147, 151, 158, 145, 141, 180–182, 12, 13, 15, 50, 237, 247, 128, 162, 168; 399/266, 291, 277, 299

[56] References Cited

U.S. PATENT DOCUMENTS

| | | | |
|---|---|---|---|
| 4,764,445 | 8/1988 | Miskinis et al. | 430/108 |
| 5,030,974 | 7/1991 | Tange | 347/147 |
| 5,196,890 | 3/1993 | Nakayama et al. | 399/222 |
| 5,440,332 | 8/1995 | Good | 347/42 |
| 5,818,476 | 10/1998 | Mey et al. | 347/40 |

FOREIGN PATENT DOCUMENTS

| | | | |
|---|---|---|---|
| 41992-141459 | 10/1990 | Japan . | |
| 3153368 | 7/1991 | Japan | 347/180 |

OTHER PUBLICATIONS

A. R. Kotz, Magnetic Stylus Recording, 1981, *Society of Photographic Scientists and Engineers,* pp. 44–49.

*Primary Examiner*—N. Le
*Assistant Examiner*—L. Anderson
*Attorney, Agent, or Firm*—Thomas H. Close

[57] ABSTRACT

Electrographic printing apparatus for forming a toner image on a recording medium includes: a magnetic brush having a rotatable magnetic core and a stationary outer shell; a developer supply for supplying a magnetic developer powder to the magnetic brush; a print head on the outer shell; and a receiver electrode arranged in spaced relation to the print head to define a recording region through which the receiver can be moved. The print head includes an array of microchannels for forming a plurality of parallel lines of developer in the channels, a corresponding plurality of transfer electrodes located in the microchannels for selectively transferring developer from the lines to a receiver, driver circuitry for generating and applying transfer signals to the transfer electrodes, a power supply connection for applying power to the drive circuitry, a print signal input connection for applying print signals to the print head, the print signal input including a number of electrical conductors fewer than the number of transfer electrodes, and a logic and control circuit for applying the print signals to the drive circuitry.

12 Claims, 6 Drawing Sheets

INTEGRATED MICROCHANNEL PRINT HEAD FOR ELECTROGRAPHIC PRINTER

FIELD OF THE INVENTION

The invention relates generally to the field of printing, and in particular to electrographic printing methods and apparatus.

BACKGROUND OF THE INVENTION

An electrographic printing process wherein a magnetically responsive electrically conductive toner material is deposited directly on a dielectric receiver as a result of electronic current flow from an array of magnetically permeable styli into toner chains formed at the tips of the styli is disclosed in an article entitled "Magnetic Stylus Recording" by A. R. Kotz, Journal of Applied Photographic Engineering 7:44–49 (1981).

The toner material described by Kotz is a single-component, magnetically responsive, electrically conductive toner powder, as distinguished from multiple-component carrier/toner mixtures also used in electrophotographic development systems. The magnetically permeable styli described by Kotz are a linear array of magnetically permeable wires potted in a suitable material and arranged such that the ends of the wires are perpendicular to the receiver surface. The styli serve as recording or transfer electrodes and effect the transfer of toner particles to a receiver. To achieve image-wise transfer of toner each transfer electrode is excited by an independently controllable voltage source through suitable interconnect wiring.

In electrographic printers utilizing a plurality of transfer electrodes, such as printers with wide-format print heads for fast writing speeds or high resolution print heads for high image quality, a large number of transfer electrodes, interconnects, and voltage sources are required. For example, an eight-inch, full-width 300 dot per inch (dpi) electrographic printer requires a print head with 2,400 transfer electrodes and equal numbers of interconnect wires and voltage sources. Such a large number of transfer electrodes makes the print head extremely costly and difficult to manufacture in a compact manner that does not force compromises in system design.

The prior art has not addressed this problem. Tange in U.S. Pat. No. 5,030,974 issued Jul. 9, 1991, describes a plurality of electrode elements for transferring toner to a receiver, but gives no discussion as to how the electrodes are interconnected to voltage sources. In one embodiment Tange discloses that the wires from the transfer electrodes are routed to the lateral edges of the print head. For a large number of electrodes this would require the length of the print head (in the direction of developer flow) to become unacceptably large. Nakayama et al. in U.S. Pat. No. 5,196,890 issued Mar. 23, 1993, describes an electrostatic recording apparatus utilizing a plurality of recording electrodes wherein the interconnecting wires from the print head follow the curvature of the development sleeve and mate to drive electronics which are housed in a protective central section of the apparatus. The protective electronics housing creates a geometrical interference that necessitates a complex developer transport system.

Thus, there is clearly a need for an electrographic print head that incorporates a large number of transfer electrodes and their associated interconnects and drive electronics in a cost-effective, compact, and manufacturable manner that does not force compromises in system design.

SUMMARY OF THE INVENTION

The present invention is directed to overcoming one or more of the problems set forth above. Briefly summarized, according to one aspect of the present invention, electrographic printing apparatus for forming a toner image on a recording medium includes: a magnetic brush having a rotatable magnetic core and a stationary outer shell; a developer supply for supplying a magnetic developer powder to the magnetic brush; a print head on the outer shell; and a receiver electrode arranged in spaced relation to the print head to define a recording region through which the receiver can be moved. The print head includes an array of microchannels for forming a plurality of parallel lines of developer in the channels, a corresponding plurality of transfer electrodes located in the microchannels for selectively transferring developer from the lines to a receiver, driver circuitry for generating and applying transfer signals to the transfer electrodes, a power supply connection for applying power to the drive circuitry, a print signal input connection for applying print signals to the print head, the print signal input including a number of electrical conductors fewer than the number of transfer electrodes, and a logic and control circuit for applying the print signals to the drive circuitry.

In one embodiment the microchannel print head is formed on a silicon substrate onto which are also formed a multiplicity of individual drive circuits connected through separate conductive paths to individual transfer electrodes. In a further embodiment all the necessary microelectronic circuitry necessary for the operation of the integrated microchannel print head is formed on the silicon substrate.

These and other aspects, objects, features and advantages of the present invention will be more clearly understood and appreciated from a review of the following detailed description of the preferred embodiments and appended claims, and by reference to the accompanying drawings.

ADVANTAGEOUS EFFECT OF THE INVENTION

The present invention has the advantages of low cost, ease of manufacturability, and small size.

BRIEF DESCRIPTION OF THE DRAWINGS

To facilitate understanding, identical reference numerals have been used, where possible, to designate identical elements that are common to the figures.

DETAILED DESCRIPTION OF THE INVENTION

Figure 1:
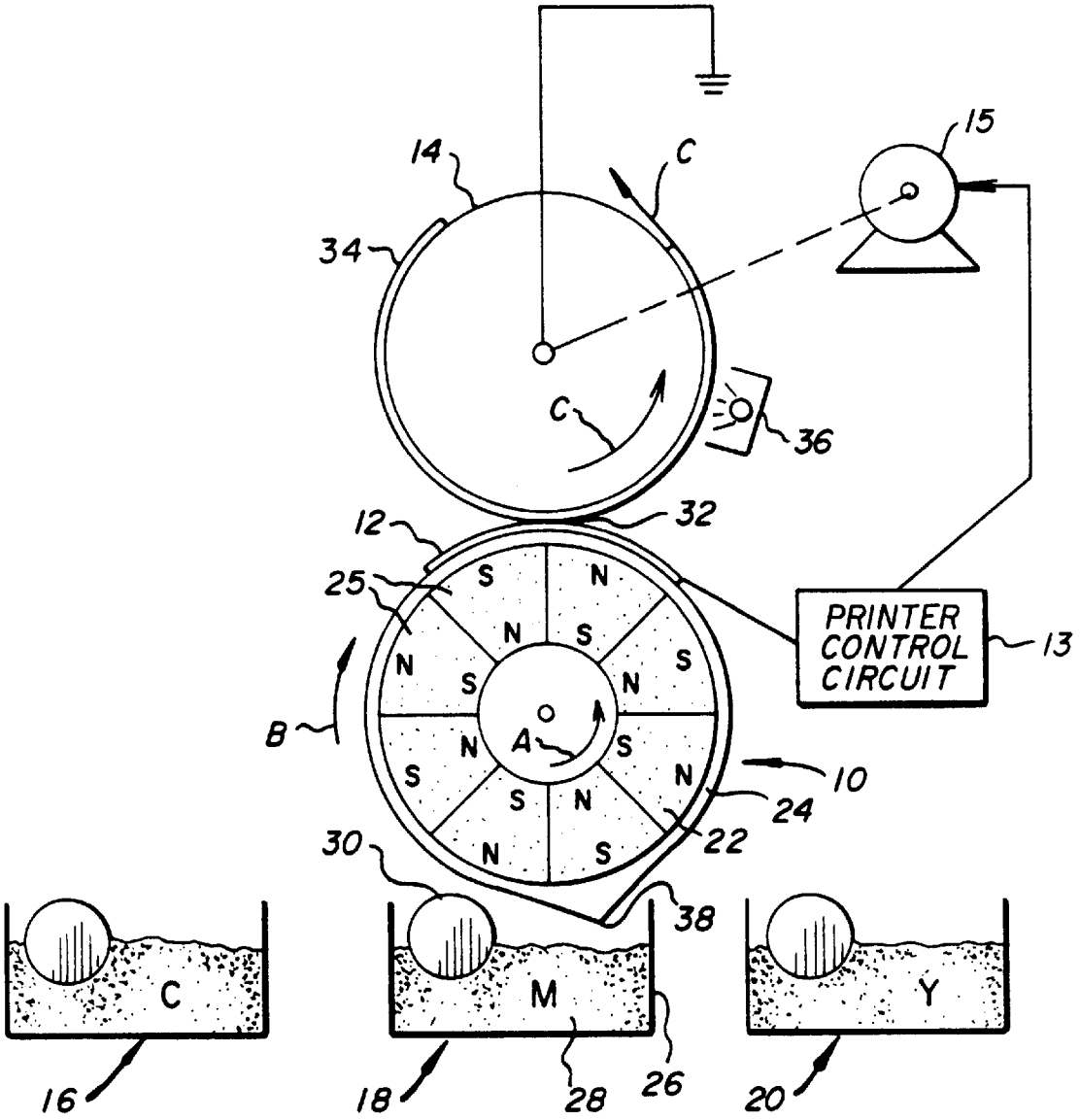
FIG. 1 is a schematic diagram of an electrographic color printer employing a microchannel print head according to the present invention.

Referring to FIG. 1, an electrographic color printer according to the present invention is shown. The printer includes a magnetic brush generally designated 10, a microchannel print head 12 driven by a printer control circuit 13 (such as a microprocessor), a receiver electrode 14 driven by a stepper motor 15, and three developer supplies 16, 18 and 20 for supplying cyan, magenta and yellow developer powder to the magnetic brush 10, respectively. In a printer adapted to print text as well as color images, a fourth developer supply (not shown) for supplying black developer powder to the magnetic brush may be provided. The stepper motor 15 is controlled by printer control circuit 13 to synchronize the printing of the different colored developers.

The magnetic brush 10 includes a rotatable magnetic core 22 and stationary outer cylindrical shell 24 characterized by low magnetic permeability and high electrical conductivity. The rotatable magnetic core includes a plurality of permanent magnetic sectors 25 arranged about and extending parallel to the cylindrical surface of the shell 24 to define a cylindrical peripheral surface having alternating North and South magnetic poles. In operation, the magnetic core 22 rotates in a counter clockwise direction as indicated by arrow A to transport developer around the circumference of shell 24 in a clockwise direction as indicated by arrow B.

Each of the three developer supplies 16, 18, and 20 is constructed in a similar manner and is moveable from a position immediately adjacent the magnetic brush 10 as illustrated by supply 18, to a position away from the magnetic brush as illustrated by supplies 16 and 20 in FIG. 1. Each developer supply includes a sump 26 for containing a supply of magnetic developer 28, for example, a two component developer of the type having an electrically conductive, magnetically attractive carrier and a colored toner. A suitable developer is described in U.S. Pat. No. 4,764,445 issued Aug. 16, 1988, to Miskinis et al. The performance of the system can be optimized by employing the carrier having a balanced conductivity low enough to triboelectrically charge the toner particle, but high enough to conduct electricity. A rotatable magnetic feed roller 30 is actuable for delivering developer 28 from the sump 26 to the magnetic brush 10 in a known manner.

The microchannel print head 12 is mounted on the outer surface of shell 24 opposite receiver electrode 14 to define a recording region 32. A receiver 34, such as dielectric coated or plain paper, is wrapped around the receiver electrode 14 and moved through the recording region 32 in the direction of arrow C with one surface in contact with receiver electrode 14. Alternatively, the direction of the receiver and the flow of developer may be in opposite directions. A fusing station 36 may be provided as is known in the art to fuse the toner image to the receiver 34. The fusing station 36 may comprise for example a radiant heat source or a hot roller.

In operation, a first developer supply, say the magenta supply 18 is moved into position adjacent the magnetic brush 10. The magnetic feed roller 30 is actuated to supply developer 28 to the magnetic brush 10. The developer 28 is transported around the periphery of the magnetic brush 10 to the recording region 32, where pulses are selectively applied to an array of transfer electrodes in microchannel print head 12 synchronized by printer control circuit 13 to transfer toner from the developer 28 to the receiver 34 in an imagewise manner as the receiver is moved by stepper motor 15 through the recording region 32. After the first color component of the image (e.g. magenta) is formed on the receiver 34, the remaining developer is removed from the magnetic brush 10.

Means are provided on the shell 24 of the magnetic brush 10 such as a lip 38 which extends a distance from the magnetic core 22 so that as the developer is transported around the periphery of the shell 24, it is moved away from the influence of the magnetic core 22 to the point where it falls back into the sump 26. Alternatively, another magnetic brush and sump (not shown) having only magnetic carrier (no toner) may be provided for cleaning. The magnetic carrier is transported around the magnetic brush to scavenge residual toner from the magnetic brush 10 and print head 12. Such an arrangement is called a magnetic brush cleaning station in the prior art.

Next, the developer supply 18 is moved away from the magnetic brush 10 and the next developer supply (e.g. the yellow developer supply 20) is moved into position to replace it. The receiver 34 is repositioned by printer control circuit 13 and stepper motor 15 to record the yellow component of the image and insure registration between the various color components and the recording process described above is repeated. Finally, the cyan component of the full color image is recorded in a similar fashion. After the three image components are recorded, the full color image is fused to the receiver 34 at fusing station 36. Alternatively, each color developer may be fused after deposition and prior to the deposition of the subsequent color.

Figure 2:
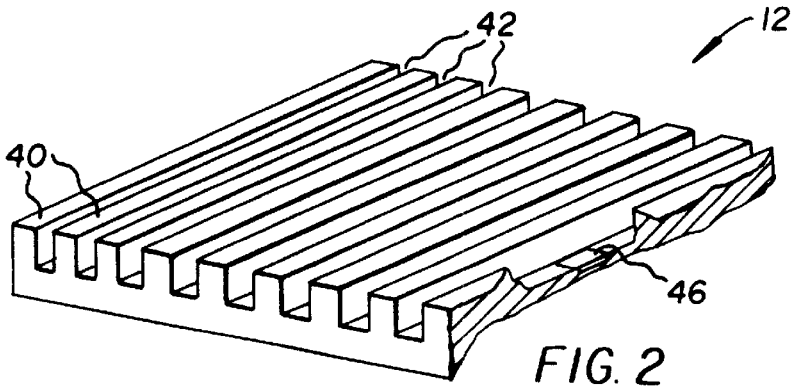
FIG. 2 is a partial perspective view of the microchannel print head employed in the present invention.
Figure 3:
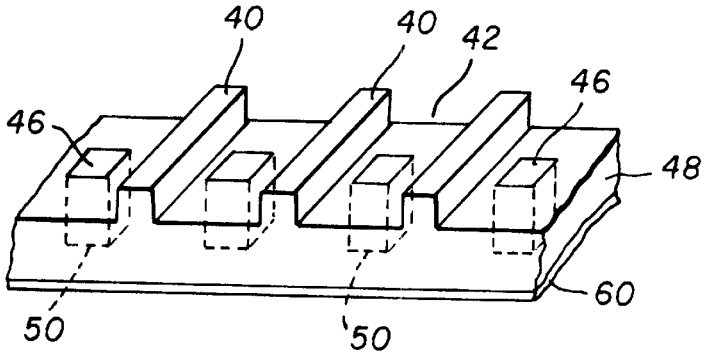
FIG. 3 is a partial perspective view of the substrate of a microchannel print head according to one embodiment of the present invention.

Referring to FIG. 2, an electrographic print head 12 according to the present invention utilizes microchannels 42 to control the flow of developer particles and individual transfer electrodes 46 to transfer the toner in pixel wise fashion to a receiver as described in U.S. Ser. No. 08/620,655, filed Mar. 22, 1996, in the names of William J. Grande et al., entitled "Microchannel Print Head for Electrographic Printer". Any commercial realization of the print head must take into account the associated drive/control electronics and the wiring that connects the drive electronics to the transfer electrodes. A constraint of any connection scheme is that there must be no interference with the flow of developer particles. This poses a serious challenge to wiring schemes that pass over either the leading or trailing edge of the print head. In the example of a 300 dpi full-page print head of eight inches width, there are 2,400 individual transfer electrodes. The large number of electrodes makes it difficult to form conductive paths that lead out to the lateral edges of the print head while still maintaining the short length (in the direction of developer travel) of the print head.

The integrated microchannel print head of the present invention can be constructed in a number of ways. According to one approach, the microchannels are formed in an additive process by applying a layer of material onto the substrate and patterning the added layer to form the channels. Additive processes may include coating, epitaxial growth, deposition, lift-off and bonding, printing and possibly subsequent patterning of the added layer. A presently preferred additive technique for forming microchannels is to pattern a thick photoimageable polymer, such as novalac photoresist, or a polyimide using standard photolithographic techniques.

In another approach the microchannels are formed by a subtractive process by removing material from the substrate to form the channels. Subtractive processes can include techniques such as etching, sawing, ion milling, electrodischarge machining, and laser cutting. A preferred technique is fast anisotropic etching into the bulk of a silicon substrate using conventional high density plasma etching techniques for silicon. The drive and control circuitry may be provided either in the form of microelectronic circuits integrated on or into the substrate or as hybrid electronic chips bonded to the substrate.

One embodiment of the integrated microchannel print head is shown in FIGS. 3–6. Microchannels 42 are formed on a silicon substrate 48 by either an additive or subtractive process. Electrical connection to the transfer electrodes 46 are formed by via plugs 50 from the bottoms of the microchannels 42 to the opposite side of the silicon substrate. In a presently preferred embodiment, the tops of the via plugs 50 function as the transfer electrodes. Alternatively, a transfer electrode may be formed over the top of and in electrical contact with the via plug 50.

The via plugs 50 can be formed using conventional electroplating techniques. A preferred method would be to attach an electrically conductive, passivated backer plate to the substrate surface opposite the microchannels 42. It is understood that all surfaces of the substrate 48 are covered with an insulating material, for example, a thermal or plasma-enhanced chemical vapor deposited (PECVD) silicon dioxide layer, so that, when immersed in an electroplating bath, deposition is initiated only on the portions of the backer plate exposed at the bottoms of via plug cavities. The electroplating process is conducted in a timed fashion so that the plated material completely fills the via plug cavity, forming the via plugs 50. As is known in the art, the passivation on the backer plate surface provides adequate electrical conductivity for the electroplating process but does not adhere well to the plated material. Thus, the wafer can be separated from the backer plate without damage by simple mechanical means. Note that the via plugs 50 are electrically insulated from the substrate 48.

Figure 4:
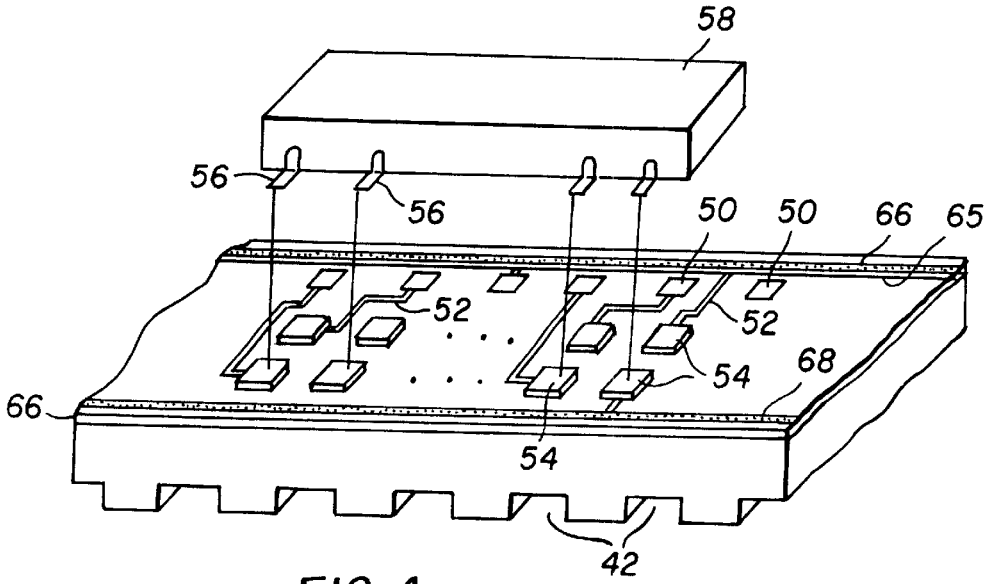
FIG. 4 is an exploded partial perspective view of a microchannel print head shown in FIG. 3.
Figure 5:
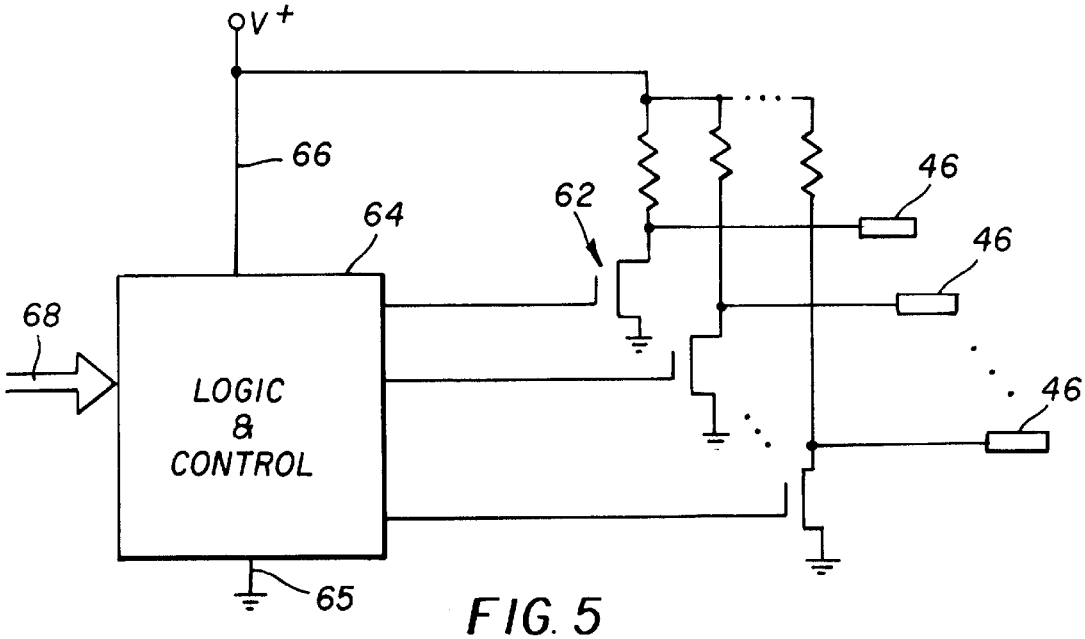
FIG. 5 is a circuit diagram showing the logic and control circuitry and drive circuits employed with the microchannel print head shown in FIG. 3.
Figure 6:
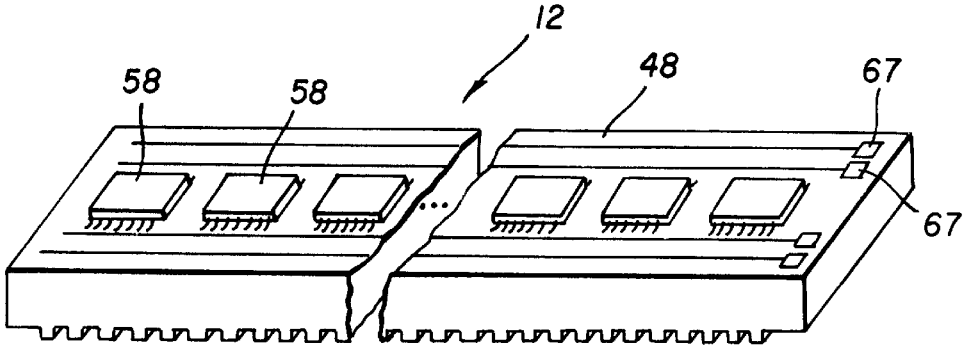
FIG. 6 is a partial perspective view showing the bottom side of a completed a microchannel print head shown in FIG. 3.

Referring to FIG. 4, conductive metal traces 52 are provided to connect the bottoms of the via plugs 50 to a set of solder bumps 54 that are configured in a geometry that matches the tabs 56 of a standard surface mount integrated circuit package 58 that contains drive circuitry for the transfer electrodes. Alternatively, the circuits may be packaged in flip-chips and the solder bumps 54 provided on the substrate 48 in the appropriate pattern for attaching the flip chip to the substrate. The conductive metal traces 52 and the solder bumps 54 are insulated from the substrate by a layer of silicon dioxide 60. As shown in FIG. 5, the integrated circuit packages 58 will typically contain a number of individual drive circuits 62 (for example, 32, 48, 64, or 128 separate drive circuits) and additional logic and control circuitry 64 for, decoding, timing, and other functions. Suitable integrated circuit packages containing drive circuits and logic and control circuitry are available as "High Voltage Driver/Interface ICs" e.g. HV03, HV34, HV622, etc., from Supertex Inc., Sunnyvale, Calif. A number of bus lines are provided along the back of the print head to supply each integrated circuit package 58 with electrical connections. These would include electrical ground 65, power supply 66, and data lines 68 for carrying the digital input signals from printing control circuit 13 that represent the image to be printed. As shown in FIG. 6, bond pads 67 are provided on the back of the substrate 48 for external electrical connection to the bus lines. As shown in FIG. 6, the number of electrical conductors 67 is fewer than the number of transfer electrodes 46 in channels 42.

In the example of an eight-inch 300 dpi print head, a minimum of 38 integrated circuit packages 58 each having 64 drive circuits may be used. The drive chips 58 are tiled along the back of the print head 12 forming a single integrated assembly, as shown in FIG. 6. Note that in this embodiment it is convenient but not necessary to use silicon as the substrate. Since no aspect of this embodiment makes use of silicon's properties, any other suitable material could be used. For example, a ceramic substrate such as that used for integrated circuit packages, plastic, glass, or a printed circuit board material such as glass loaded epoxy may be used as the substrate material.

Figure 7:
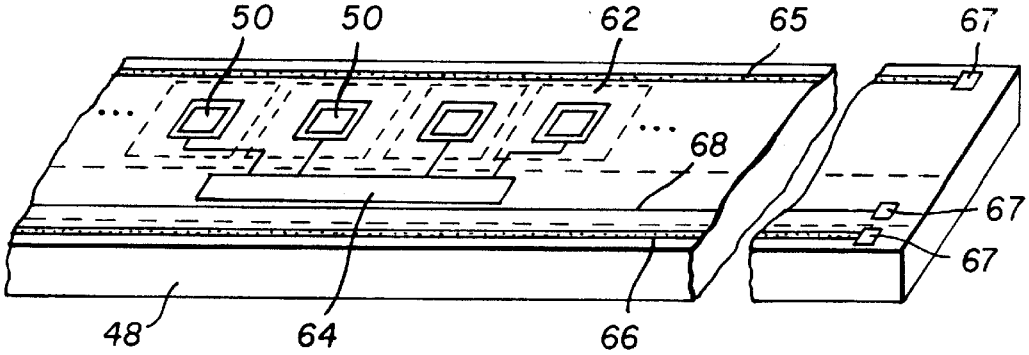
FIG. 7 is a partial perspective view of the substrate of a microchannel print head according to an alternative embodiment of the present invention.
Figure 8:
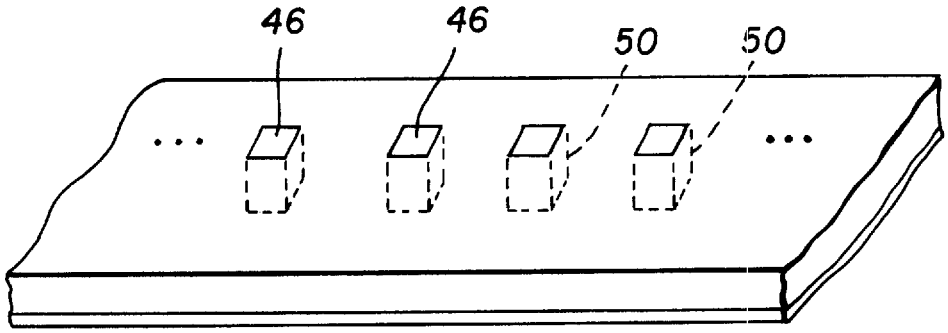
FIG. 8 is a partial perspective view showing the top of substrate shown in FIG. 7.
Figure 9:
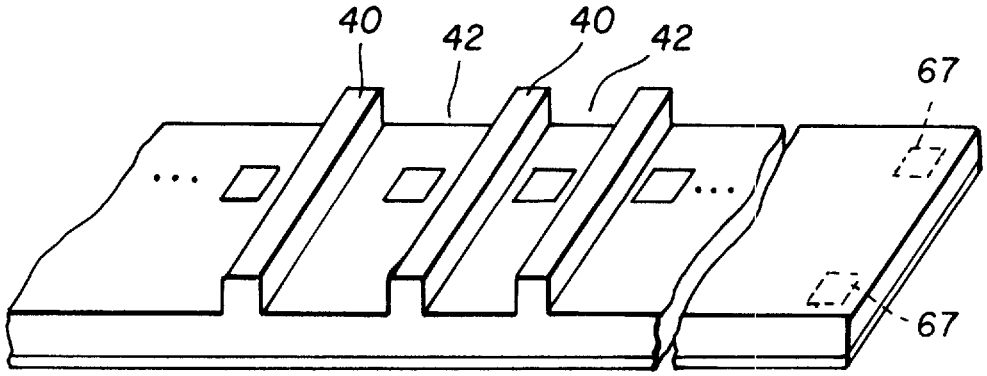
FIG. 9 is partial perspective view of the completed microchannel print head shown in FIG. 7.

Another embodiment of the integrated microchannel print head according to the present invention is shown in FIGS. 7–9. Microelectronic circuitry including the drive circuits 62 adjacent to the bottom surfaces of the via plugs 50 and the logic and control circuitry 64 connected to the driver circuits 62, is first formed on the bottom surface of a silicon substrate 48 as shown in FIG. 7. Note that the bottom surface of the substrate 48 shown in FIG. 7 will become the bottom surface of the print head 12. Each individual drive circuit 62 provides a voltage to a single transfer electrode 46 through a via plug 50. As shown in FIG. 7, the number of electrical conductors 67 is fewer than the number of via plugs 50 connected to transfer electrodes 46.

The voltages required for proper operation of the microchannel print head 12 are typically in the range 50–200 volts. A microelectronic fabrication technology such as high voltage complementary metal oxide semiconductor (HVCMOS) or doubly diffused metal oxide semiconductor (DMOS) is employed to obtain such voltages. The pitch of the individual drive circuit channels matches the desired pitch of the print head. The via plugs 50 are arranged in such a geometry that there is back-to-front correspondence of the via plugs 50 and the intended positions of the transfer electrodes 46. Logic and control circuitry 64 is arranged along one or both edges of the print head. A number of bus lines are provided along the back of the print head to supply each integrated circuit 62 and 64 with external electrical connections. These would include electrical ground 65, power supply 66, and data lines 68 for carrying the digital input signals from printing control circuit 13 that represent the image to be printed. Bond pads 67 are provided on the back of the substrate 48 for external electrical connection to the bus lines. Logic and control circuitry 64 can be formed using a standard fabrication technology such as CMOS. Control, decoding, timing, and other functions are performed by this circuitry. The substrate 48 with the integrated circuitry formed on it can be purchased from a foundry that specializes in application specific integrated circuits (ASICs). This reduces the capital requirements needed to build integrated microchannel print heads according to the present invention.

The transfer electrodes 46 and via plugs 50 are formed, as shown in FIG. 8 as described above. The alignment of the transfer electrodes 46 and via plugs 50 with respect to the drive circuits 62 is accomplished by suitable lithographic techniques such as infrared alignment or front-to-back alignment. Referring to FIG. 9, microchannel walls 40 are formed on the top side of the substrate 48 by one of the additive techniques noted above.

Figure 10:
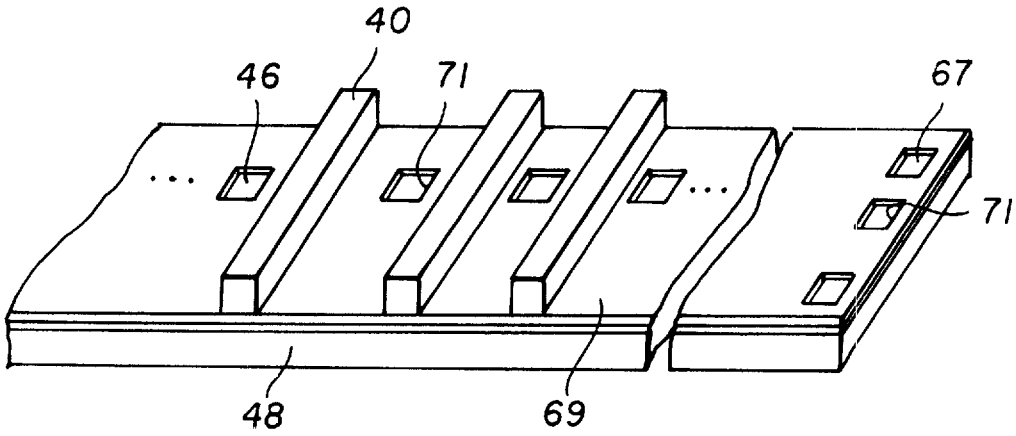
FIG. 10 is a top partial perspective view of a further alternative embodiment of a microchannel print head according to the present invention.

An alternative method of forming a microchannel printhead according to the present invention, starting with a substrate 48 similar to that shown in FIG. 7 with multiple individual drive circuits 62 and logic and control circuitry 64, is shown in FIG. 10. Rather than forming via plugs 50, a series of transfer electrodes 46 are formed as a part of the drive circuits 62. In this embodiment, the surface of the substrate containing the circuitry is considered the top surface of the substrate 48. An insulating and/or anti-abrasion layer is formed on the top surface of the substrate 48 so as to protect the microelectronic circuitry. Openings 71 are formed in the insulating/anti-abrasion layer 69 to expose the transfer electrodes 46 and bonding pads 67. A suitable insulating/anti-abrasion layer 69 is provided by a PECVD silicon dioxide or silicon nitride that is patterned using standard photolithographic and etching techniques. A completed print head 12 is formed, as shown in FIG. 10, by adding microchannels walls 40 through an additive technique such as thick photoimageable polymer processing as discussed above.

Figure 11:
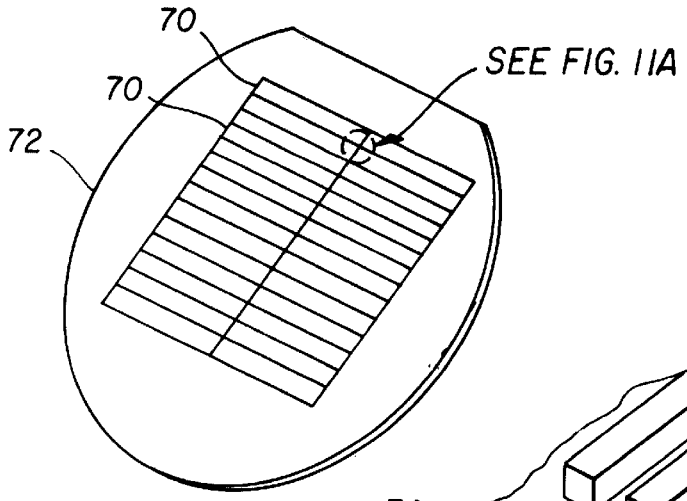
FIGS. 11 and 11A are a perspective view showing a plurality of print head dice on a silicon wafer.
Figure 11A:
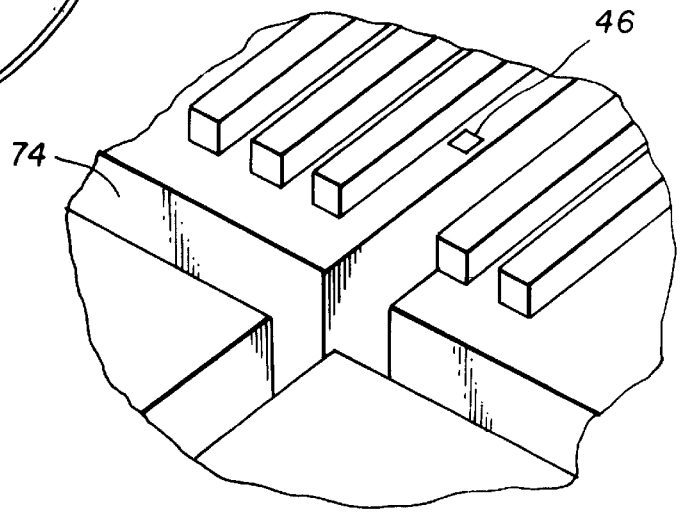
Figure 12:
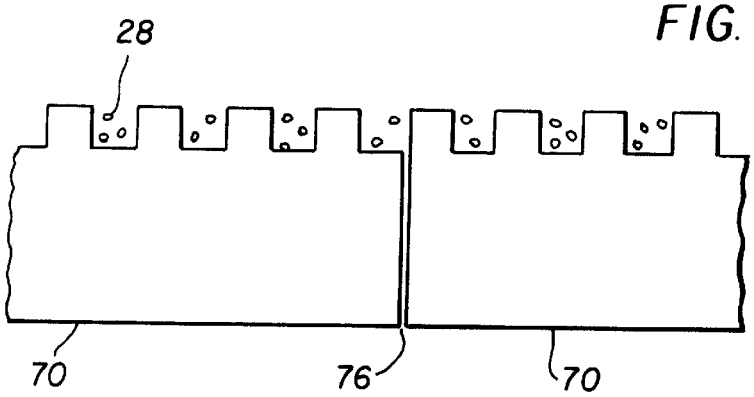
FIG. 12 is an end view showing one arrangement for joining print head dice on a print head.
Figure 13:
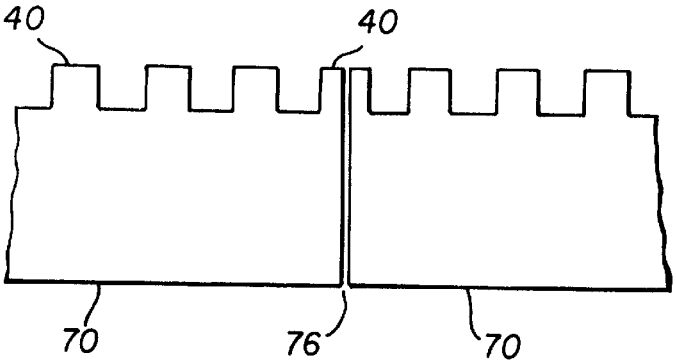
FIG. 13 is an end view showing an alternative arrangement for joining print head dice on a print head.

The largest diameter silicon substrates currently used in production are eight and twelve inch (200 or 300 mm) wafers. Because of this inherent limitation on the size of the silicon wafer, it may be desirable or necessary to form wide format print heads 12 by arranging a number of smaller print head dice 70 in spaced relation, as shown in FIGS. 11–13. FIGS. 11 and 11A show how individual print head dice 70 can be separated from a fully processed silicon wafer 72. Conventional wafer sawing or through-wafer trenches formed by high density plasma etching are the preferred methods of forming the separation trenches 74. The separation trenches are aligned such that two or more print head dice 70 can be butted together without interrupting the periodicity of the microchannel array, as shown in FIG. 12. The resulting seam 76 between print head dice 70 is sufficiently narrow such that proper flow of developer 28 is maintained. FIG. 13 shows an alternative geometry for formation of separation trenches 74 such that the seams 76 occur at the position of the microchannel walls 40.

Figure 14:
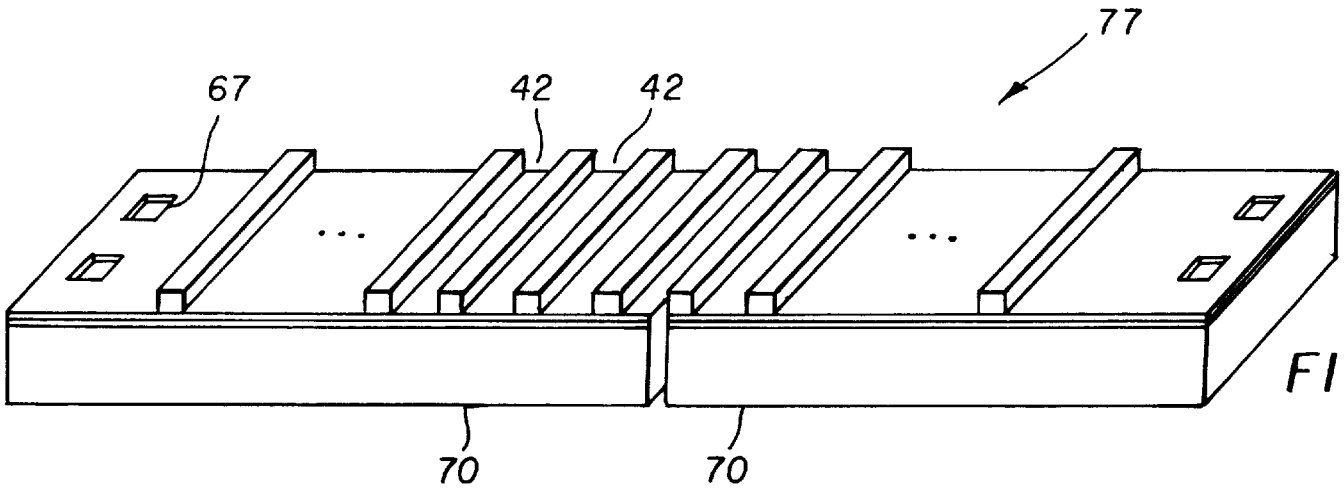
FIG. 14 is a perspective view of a print head formed from two print head dice.
Figure 15:
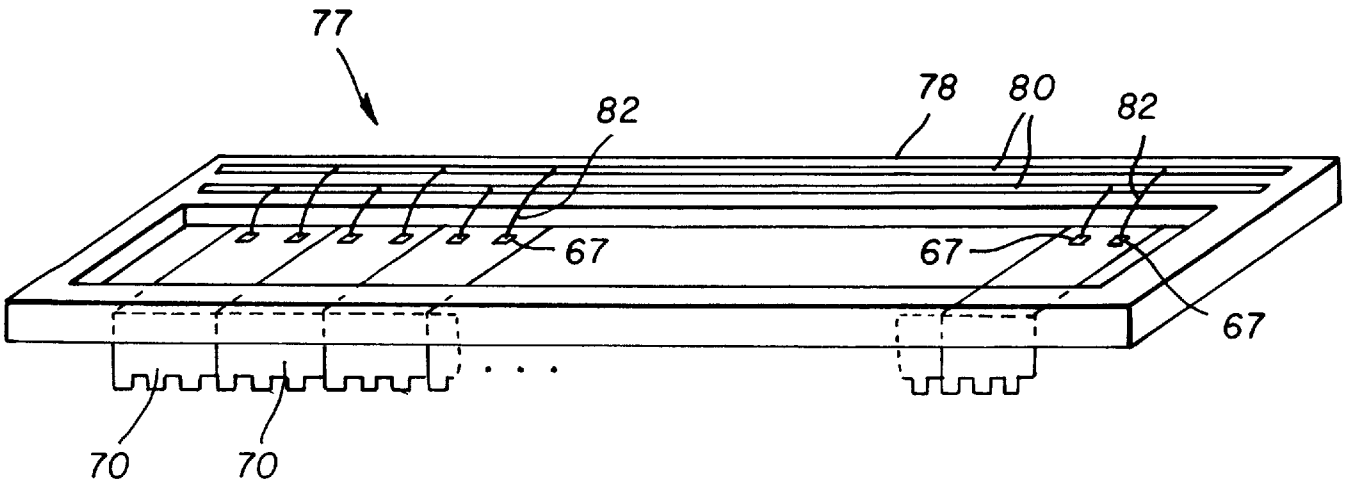
FIG. 15 is a bottom perspective view of a print head formed from a larger number of print head dice.

For the print head configuration as exemplified in FIG. 10 where the bond pads 67 and microchannels 42 are formed on the same side of the wafer, the maximum number of print head dice 70 that can be butted together is two, with the bond pads 67 arranged at the respective ends of the assembled print head 77, as shown in FIG. 14. For the print head configuration as exemplified in FIG. 9 where the bond pads 67 and microchannels 42 are formed on opposite sides of the wafer, multiple print head dice 70 can be butted together, as shown in FIG. 15, by mounting the dice on a frame 78 containing a number of frame bus lines 80. The frame bus lines 80 distribute common electrical signals, such as power, timing, control, etc., to the multiplicity of print head dice 70 via wire bonds 82 between the frame bus lines 80 and the bond pads 67. Using this arrangement the assembled print head 77 can be fabricated in arbitrarily long lengths.

The invention has been described with reference to a preferred embodiment. However, it will be appreciated that variations and modifications can be effected by a person of ordinary skill in the art without departing from the scope of the invention. For example, although the invention has been described showing only one transfer electrode per channel, each channel may be provided with a plurality of transfer electrodes and angled microchannels.

PARTS LIST

10 magnetic brush
12 microchannel print head
13 printer control circuit
14 receiver electrode
15 stepper motor
16 developer supply (cyan)
18 developer supply (magenta)
20 developer supply (yellow)
22 rotatable magnetic core
24 stationary outer shell
25 permanent magnetic sectors
26 sump
28 developer
30 magnetic feed roller
32 recording region
34 receiver
36 fusing station
38 lip on magnetic brush shell
40 microchannel walls
42 microchannels
46 transfer electrode
48 substrate
50 via plug
52 conductive metal traces
54 solder bumps
56 tabs
58 integrated circuit package
60 insulating layer
62 drive circuit
64 logic and control circuitry
65 electrical ground bus
66 power supply bus
67 bond pad
68 data line bus
69 insulating/anti-abrasion layer
70 print head dice
71 openings
72 processed silicon wafer
74 separation trenches
76 seam
77 assembled print head
78 frame
80 frame bus lines
82 wire bonds

We claim:

1. Electrographic printing apparatus for forming a toner image on a recording medium, comprising:

a) a magnetic brush having a rotatable magnetic core and a stationary outer shell;

b) a developer supply for supplying a magnetic developer powder to the magnetic brush;

c) a print head on the outer shell, the print head including, i) an array of microchannels in a substrate for forming a plurality of parallel lines of developer in the channels, ii) a corresponding plurality of transfer electrodes located in the microchannels for selectively transferring developer from the lines to a receiver, iii) driver circuitry located on the opposite side of the substrate from the microchannels for generating and applying transfer signals to the transfer electrodes, iv) a power supply connection for applying power to the drive circuitry, v) a print signal input connection for applying print signals to the print head, the print signal input including a number of electrical conductors fewer than the number of transfer electrodes, vi) logic and control means located on the opposite side of the substrate from the microchannels for applying the print signals to the drive circuitry, and vii) electrical connection between the driver circuitry and the transfer electrodes being formed by via plugs from the bottoms of the microchannels to the opposite side of the substrate; and d) a receiver electrode arranged in spaced relation to the array of microchannels to define a recording region through which the receiver can be moved.

2. The electrographic printing apparatus claimed in claim 1, wherein the microchannels are formed in the silicon substrate by micro-machining.

3. The electrographic printing apparatus claimed in claim 1, wherein the microchannels are formed on the silicon substrate by patterned photopolymer.

4. The electrographic printing apparatus claimed in claim 1, wherein the driver circuitry and logic and control means are separate integrated circuits that are attached to the back of the substrate.

5. The electrographic printing apparatus claimed in claim 1, wherein the substrate is silicon.

6. The electrographic printing apparatus claimed in claim 1, wherein the substrate is ceramic.

7. The electrographic printing apparatus claimed in claim 1, wherein the substrate is glass loaded epoxy circuit board material.

8. The electrographic printing apparatus claimed in claim 1, wherein the substrate is plastic.

9. The electrographic printing apparatus claimed in claim 1, wherein the substrate is glass.

10. The electrographic printing apparatus claimed in claim 1, wherein the drive circuitry is HVCMOS and the logic and control means is CMOS.

11. The electrographic printing apparatus claimed in claim 1, wherein the drive circuitry is DMOS and the logic and control means is CMOS.

12. The electrographic printing apparatus claimed in claim 1, wherein the print head is formed from a plurality of silicon segments.

* * * * *